US009733603B2

(12) United States Patent
Soma et al.

(10) Patent No.: US 9,733,603 B2
(45) Date of Patent: Aug. 15, 2017

(54) IMAGE FORMING APPARATUS, IMAGE PROCESSING METHOD, AND COMPUTER-READABLE RECORDING MEDIUM FOR IMAGE TONE CORRECTION

(71) Applicants: Takashi Soma, Kanagawa (JP); Takuroh Sone, Kanagawa (JP); Hideyuki Kihara, Kanagawa (JP); Naoto Watanabe, Kanagawa (JP); Takeshi Ogawa, Kanagawa (JP)

(72) Inventors: Takashi Soma, Kanagawa (JP); Takuroh Sone, Kanagawa (JP); Hideyuki Kihara, Kanagawa (JP); Naoto Watanabe, Kanagawa (JP); Takeshi Ogawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/068,972

(22) Filed: Mar. 14, 2016

(65) Prior Publication Data

US 2016/0274520 A1 Sep. 22, 2016

(30) Foreign Application Priority Data

Mar. 17, 2015 (JP) ..... 2015-053944

(51) Int. Cl.
*G03G 15/01* (2006.01)
*G03G 15/00* (2006.01)

(52) U.S. Cl.
CPC . *G03G 15/5058* (2013.01); *G03G 2215/0129* (2013.01); *G03G 2215/0164* (2013.01)

(58) Field of Classification Search
CPC ..... G03G 15/5025; G03G 15/0131; G03G 15/5054; G03G 15/5058
(Continued)

(56) References Cited

U.S. PATENT DOCUMENTS 6,839,153 B1 * 1/2005 Shimizu ..... H04N 1/4097 358/1.12
2009/0238591 A1 9/2009 Watanabe et al.
(Continued)

FOREIGN PATENT DOCUMENTS

JP 2011-257709 12/2011

OTHER PUBLICATIONS

U.S. Appl. No. 14/796,385, filed Jul. 10, 2015.

*Primary Examiner* — Billy Lactaoen
*Assistant Examiner* — Arlene Heredia Ocasio
(74) *Attorney, Agent, or Firm* — Oblon, McClelland, Maier & Neustadt, L.L.P.

(57) ABSTRACT

An electrophotographic image forming apparatus for forming an image in accordance with image information includes: an image forming unit configured to form an image that is uniform in area percentage of each of primary colors and a secondary color on an intermediate transfer belt; a measurer configured to measure amounts corresponding to density distribution of residual toner left on the intermediate transfer belt, on which the image uniform in area percentage of each of the primary colors and the secondary color is formed and from which toner is transferred onto a recording medium, in the main-scanning direction; and a corrector configured to correct a tone value of the image information so as to reduce density nonuniformity of a streak region observed in the density distribution in the main-scanning direction using the amounts measured by the measurer.

10 Claims, 6 Drawing Sheets

(58) Field of Classification Search
USPC ..... 399/350
See application file for complete search history.

(56) References Cited

U.S. PATENT DOCUMENTS

| | | | | |
|---|---|---|---|---|
| 2010/0080596 | A1* | 4/2010 | Gross | G03G 15/161 399/66 |
| 2012/0121276 | A1* | 5/2012 | DiRubio | G03G 15/1605 399/31 |
| 2012/0155899 | A1 | 6/2012 | Watanabe et al. | |
| 2012/0320386 | A1 | 12/2012 | Sone et al. | |
| 2014/0112675 | A1* | 4/2014 | Hirata | G03G 15/5062 399/49 |
| 2014/0347417 | A1* | 11/2014 | Murayama | B41J 2/2142 347/19 |
| 2015/0037054 | A1* | 2/2015 | Nagata | G03G 15/5058 399/49 |
| 2015/0110505 | A1* | 4/2015 | Takahashi | G03G 15/5062 399/15 |
| 2015/0156373 | A1 | 6/2015 | Fujita et al. | |
| 2015/0350491 | A1 | 12/2015 | Iwata et al. | |

* cited by examiner

IMAGE FORMING APPARATUS, IMAGE PROCESSING METHOD, AND COMPUTER-READABLE RECORDING MEDIUM FOR IMAGE TONE CORRECTION

CROSS-REFERENCE TO RELATED APPLICATIONS

The present application claims priority to and incorporates by reference the entire contents of Japanese Patent Application No. 2015-053944 filed in Japan on Mar. 17, 2015.

BACKGROUND OF THE INVENTION

1. Field of the Invention

The present invention relates generally to image forming apparatuses, image processing methods, and computer-readable recording media.

2. Description of the Related Art

With regard to electrophotographic image forming apparatuses, importance is placed on consistency in color of output images. The term "consistency" used herein indicates that each image is output in conformance with designated density and area percentage. If an output image greatly differs in density from input image data, the image is assumed to be defective. For this reason, a technique of correcting information representing an image to be output using data obtained by measuring an output image has been devised.

A method of correcting a light amount and information representing an image to be output using density information obtained from a formed sample image is disclosed in Japanese Laid-open Patent Application No. 2011-257709. Specifically, the method includes forming a sample image of a predetermined density range, measuring densities of the image, and calculating correction information from density information, i.e., the measured densities, in the main-scanning direction.

However, a study carried out by inventors of the present invention indicates that the conventional method of performing correction using only information obtained from an output image of a single color can cause, when the correction is applied to a mixed color, a streak, which does not appear when the correction is applied to a single color, resulting from density nonuniformity to appear, which is disadvantageous.

Therefore, there is a need for an electrophotographic image forming apparatus configured to reduce an image defect resulting from density nonuniformity of single-color and, furthermore, reduce an image defect resulting from density nonuniformity of mixed-color caused by the reduction of the density nonuniformity of single-color.

It is an object of the present invention to at least partially solve the problem in the conventional technology.

SUMMARY OF THE INVENTION

It is an object of the present invention to at least partially solve the problems in the conventional technology.

According to exemplary embodiments of the present invention, there is provided an electrophotographic image forming apparatus for forming an image in accordance with image information, the image forming apparatus comprising: an image forming unit configured to form an image on an intermediate transfer belt, the image being uniform in area percentage of each of primary colors and a secondary color; a measurer configured to measure amounts corresponding to density distribution of residual toner left on the intermediate transfer belt, on which the image uniform in area percentage of each of the primary colors and the secondary color is formed and from which toner is transferred onto a recording medium, in the main-scanning direction; and a corrector configured to correct a tone value of the image information so as to reduce density nonuniformity of a streak region observed in the density distribution in the main-scanning direction using the amounts measured by the measurer.

Exemplary embodiments of the present invention also provide an image processing method for an electrophotographic image forming apparatus for forming an image in accordance with image information, the image processing method comprising: forming, by an image forming unit, an image on an intermediate transfer belt, the image being uniform in area percentage of each of primary colors and a secondary color; measuring, by a measurer, amounts corresponding to density distribution of residual toner left on the intermediate transfer belt, on which the image uniform in area percentage of each of the primary colors and the secondary color is formed and from which toner is transferred onto a recording medium, in the main-scanning direction; and correcting, by a corrector, a tone value of the image information so as to reduce density nonuniformity of a streak region observed in the density distribution in the main-scanning direction using the amounts measured by the measurer.

Exemplary embodiments of the present invention also provide a non-transitory computer-readable recording medium storing program instructions that, when executed in an electrophotographic image forming apparatus for forming an image in accordance with image information and including an image forming unit configured to form an image on an intermediate transfer belt, the image being uniform in area percentage of each of primary colors and a secondary color and a measurer configured to measure amounts corresponding to density distribution of residual toner left on the intermediate transfer belt, on which the image uniform in area percentage of each of the primary colors and the secondary color is formed and from which toner is transferred onto a recording medium, in the main-scanning direction, causes the image forming apparatus to correct a tone value of the image information so as to reduce density nonuniformity of a streak region observed in the density distribution in the main-scanning direction using the amounts measured by the measurer.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments are described in detail below with reference to the accompanying drawings.

Figure 1:
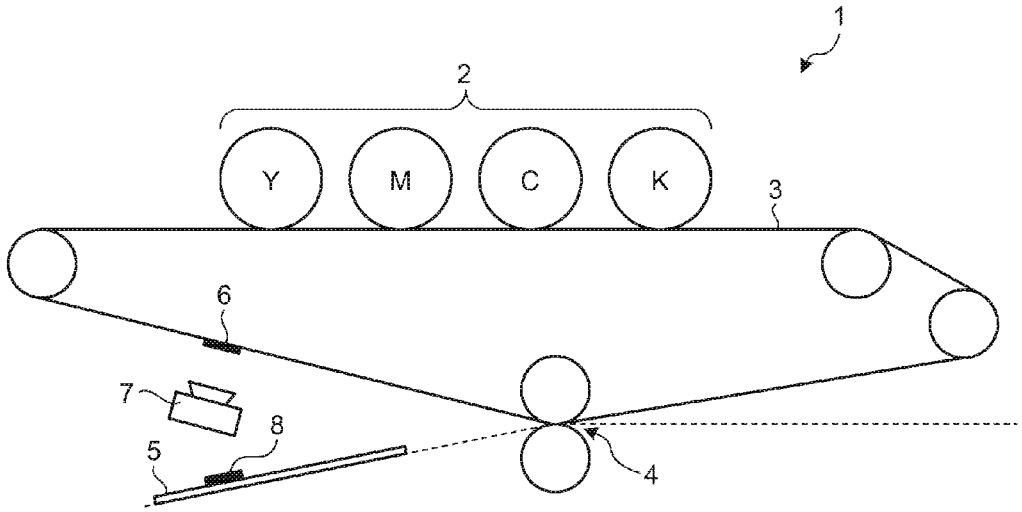
FIG. 1 is a diagram describing an example internal configuration of an image forming apparatus according to an embodiment of the present invention.

FIG. 1 is a diagram describing an example internal configuration of an image forming apparatus according to an embodiment of the present invention. For brevity of description, only relevant parts of the image forming apparatus are illustrated in FIG. 1.

An image forming apparatus 1 of the present embodiment is an electrophotographic image forming apparatus. In the image forming apparatus 1, a developing device (which is an example of "image forming unit") 2 performs a primary transfer process of transferring a toner image to an intermediate transfer belt 3; a secondary transfer unit 4 performs a secondary transfer process of transferring the toner image to a recording medium 5. In the present embodiment, a reflectance measuring instrument 7, which is an example of "measurer", is arranged downstream of the secondary transfer unit 4 in a sheet feeding direction so that reflectance of residual toner 6 on the intermediate transfer belt 3 having undergone the secondary transfer process can be measured. The sheet feeding direction is the direction, from right to left in FIG. 1, along which the recording medium 5 is conveyed. After the secondary transfer process, toner 8 transferred onto the recording medium 5 is sticking on the surface of the recording medium 5, while toner that is not transferred to the recording medium 5 is left on the surface of the intermediate transfer belt 3 as the residual toner 6. Information of reflectances measured by the reflectance measuring instrument 7 as amounts corresponding to density distribution is fed to a density-nonuniformity correcting unit 10 (see FIG. 2), which is an example of "corrector", described below. The image forming apparatus 1 is similar to a typical electrophotographic image forming apparatus in hardware configuration except that the image forming apparatus 1 includes the reflectance measuring instrument 7. The measurer is not limited to the reflectance measuring instrument 7. Any unit or device capable of measuring other amounts than the reflectances corresponding to the density distribution in the main-scanning direction can alternatively be employed.

Figure 2:
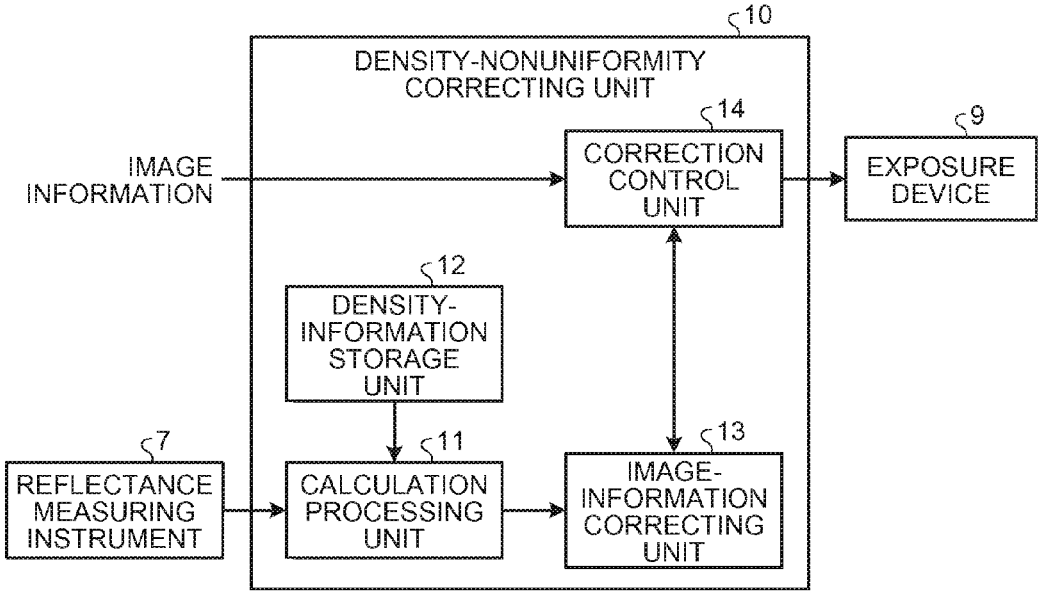
FIG. 2 is a diagram describing a schematic configuration of a density-nonuniformity correcting unit.

A schematic configuration of the density-nonuniformity correcting unit 10 is described below. FIG. 2 is a diagram describing the schematic configuration of the density-nonuniformity correcting unit 10.

A density-nonuniformity correcting unit 10 includes a calculation processing unit 11, a density-information storage unit 12, an image-information correcting unit 13, and a correction control unit 14.

The calculation processing unit 11 calculates density information representing density distribution in the main-scanning direction necessary for generating tone correction information. This calculation is performed using the information regarding the reflectances (i.e., the amounts corresponding to the density distribution in the main-scanning direction), measured by the reflectance measuring instrument 7, of the residual toner 6 on the surface of the intermediate transfer belt and information representing a reflectance-versus-density relationship measured and stored in the density-information storage unit 12, which is an example of "storage unit", in advance. This will be described in detail later.

The image-information correcting unit 13 generates, from the density information calculated by the calculation processing unit 11, tone correction information for use in correcting image information in a manner that reduces density nonuniformity of a streak region observed in the density distribution in the main-scanning direction. This will be described in detail later.

The correction control unit 14 corrects a tone value of information representing an image to be output using the tone correction information generated by the image-information correcting unit 13. The image information corrected in the manner that reduces the density nonuniformity of the streak region observed in the density distribution in the main-scanning direction is transmitted to an exposure device 9, whereby a corrected image free from streak is to be formed.

Figure 3:
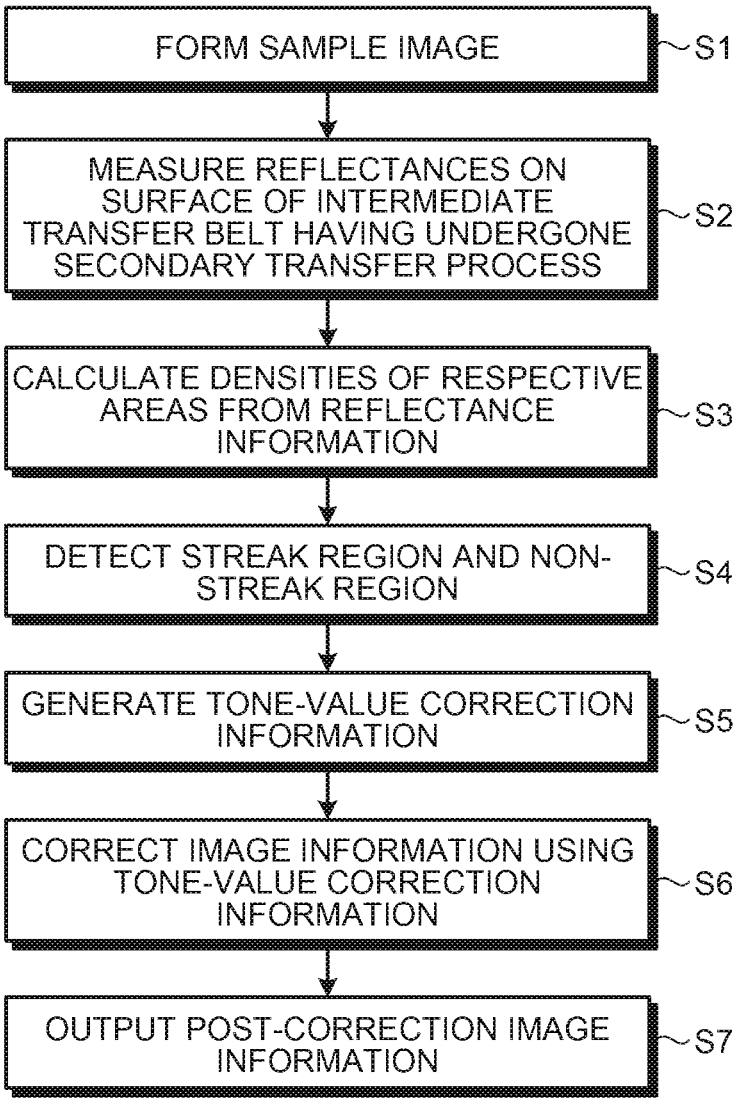
FIG. 3 is a flowchart describing a flow of operations for correcting image information performed by the image forming apparatus of the present embodiment.

A flow of operations for correcting image information performed by the image forming apparatus 1 of the present embodiment is described below. FIG. 3 is a flowchart describing the flow of operations for correcting image information performed by the image forming apparatus 1 of the present embodiment. In FIG. 3, Steps S1 to S5 are processes for generating tone-value correction information; Steps S6 and S7 are processes for outputting an image corrected using the generated tone-value correction information.

Step S1: Form Sample Image

At Step S1, the image forming apparatus 1 forms a sample image. The sample image of the present embodiment is made up of patches having a shape extending substantially across a sheet of print media at least in the main-scanning direction and formed in such a manner that area percentage for each toner is uniform in each of the patches. The term "area percentage is uniform" used herein means that, for each of the used toners, the area covered with the toner is substantially the same in any region of the patch. When a sample image of an area percentage Y (yellow) 50% and C (cyan) 50% is taken as an example, the sample image is regarded as having a uniform area percentage if the area percentage is Y50% and C50% in any region. Colors and area percentage of the sample image to be formed are not limited to those described above. Examples of the sample image to be formed may include a mixed color of Y70% and M (magenta) 40% and a mixed color of Y30%, M30%, and C40%. It is required that the sample image to be formed should include patches of every toner used in the color to be corrected. For example, to correct B (black), it is necessary to form patches of magenta and cyan that are used in black.

Figure 4:
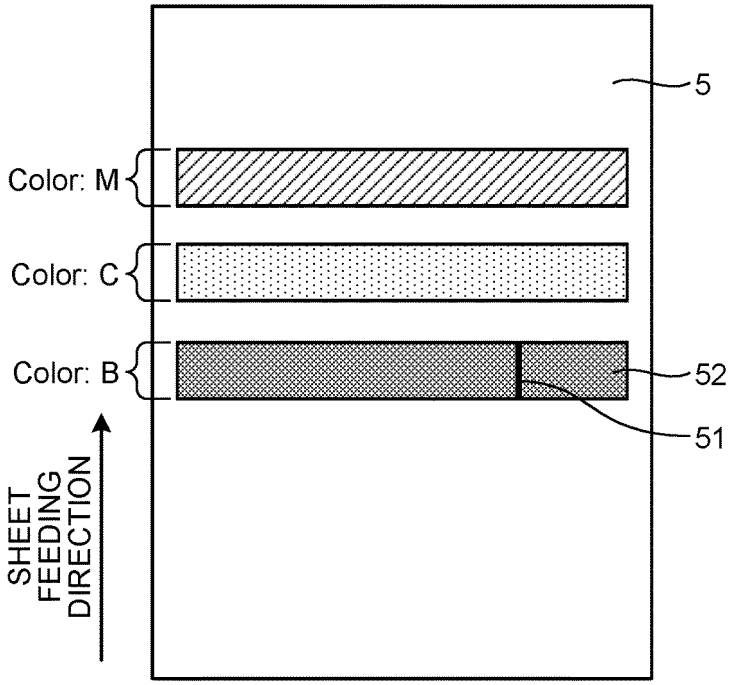
FIG. 4 is a diagram illustrating an example of a sample image formed on a recording medium.

FIG. 4 illustrates an example of a sample image formed on the recording medium 5.

FIG. 4 illustrates an example of an image made up of a patch of a single-color (primary color) of an area percentage M50%, a patch of a single-color of an area percentage C50%, and a patch of a mixed-color (secondary color) of an area percentage M50%+C50% (i.e., B). The colors and area percentages used therein are not limited to those described above; any color and area percentage can be used. When such patches as those described above are formed as the sample image, the image formed on the recording medium 5 can have a streak 51 in a mixed-color area 52 even if no streak appears in the single-color patches as illustrated in FIG. 4.

Step S2: Measure Reflectances on Surface of Intermediate Transfer Belt Having Undergone Secondary Transfer Process The calculation processing unit 11 measures, using the reflectance measuring instrument 7, reflectances in the main-scanning direction of toner (the residual toner 6) left on the intermediate transfer belt 3 after the sample image formed at Step S1 is transferred in the secondary transfer process. The reflectances are measured using a light source (not shown) emitting light including the infrared region in this example. The reason why the light source emitting light including the infrared region is used is as follows. Because the intermediate transfer belt 3 highly absorbs light in the visible light region because the color of the intermediate transfer belt 3 is generally close to block, it is difficult to measure reflected light using a light source emitting light in the visible light region. The measurement is performed on the intermediate transfer belt 3 having undergone the secondary transfer process, so that correction of a mixed-color area of a secondary or higher-order color can be performed easily. In an area where a mixed color of two or more colors is used, most of the residual toner 6 left on the intermediate transfer belt 3 after the transfer process is only toner of one color that is closest to and sticking to the belt, unlike on the recording medium 5. Therefore, a method (which is described later) for calculating a correction value from the reflectances can be simplified by measuring the residual toner 6.

A measurement area of the residual toner 6 on the intermediate transfer belt 3 having undergone the secondary transfer process is described below with reference to FIG. 5.

Figure 5:
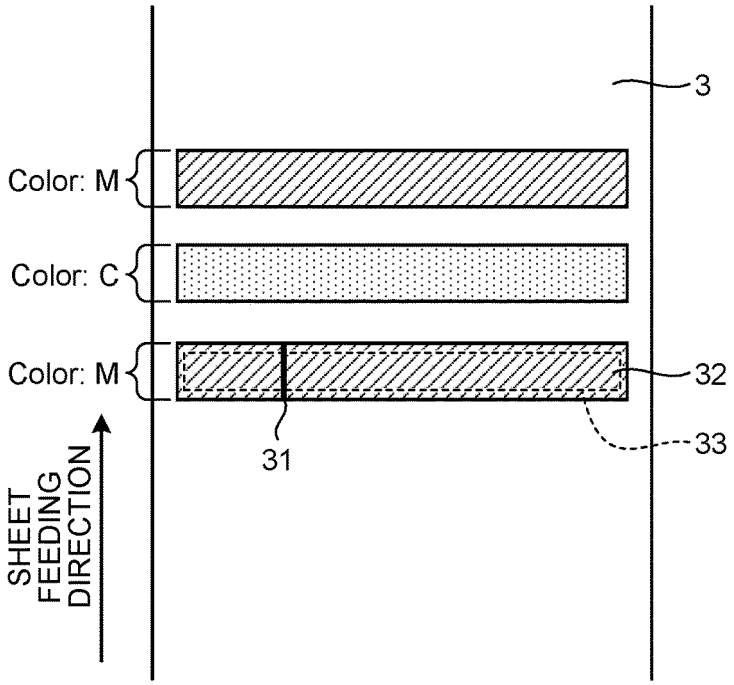
FIG. 5 is a diagram for describing a toner measurement area on an intermediate transfer belt having undergone a secondary transfer process.

When such a sample image as illustrated in FIG. 4 is formed on the recording medium 5, a streak 31 in a mixed-color area 32 appears also on the intermediate transfer belt 3 having undergone the secondary transfer process as illustrated in FIG. 5. Reflectances of the residual toner 6 in a measurement area 33 on the intermediate transfer belt 3 are measured in the main-scanning direction. What matters here is that, even in an area corresponding to the mixed-color area on the recording medium 5, only a single color of bottom-layer toner (which corresponds to top-layer toner on the recording medium 5) is on the intermediate transfer belt 3. Hence, by measuring reflectances on the intermediate transfer belt 3 having undergone the secondary transfer process, density information for use in generating tone correction information can be calculated easily even for mixed-color areas.

Step S3 Calculate Densities of Respective Areas from Reflectance Information The calculation processing unit 11 calculates densities of respective colors from the reflectances measured at Step S2. Reflectances and densities can be put into one-to-one correspondence. Therefore, the densities of the respective colors are calculated using a table representing this relationship measured and stored in advance. Because the relationship between these values varies from one toner to another, it may be necessary to generate the table for each type of toners to be used.

Figure 6:
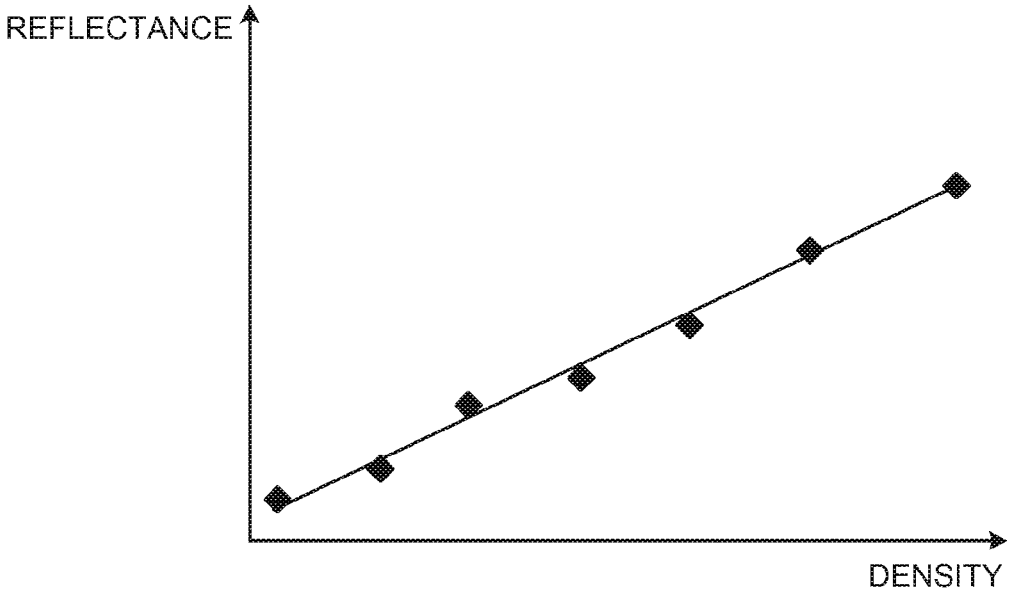
FIG. 6 is a diagram illustrating an example of toner-reflectance-versus-density relationship.

FIG. 6 illustrates an example of toner-reflectance-versus-density relationship. The reflectances illustrated in FIG. 6 are, more specifically, diffuse reflectances. Because the relationship depends on the type of toner, these values are measured and stored as a table in advance as described above. Alternatively, the relationship may be determined during calibration by measuring a plurality of patches that differ in tone value using a colorimeter.

Step S4: Detect Streak Region and Non-Streak Region

The calculation processing unit 11 detects a streak region and a non-streak region using the density information calculated at Step S3. The streak region and the non-streak region are determined from a density profile in the main-scanning direction (i.e., a profile representing density distribution in the main-scanning direction). The calculation processing unit 11 calculates an average value (average density) of the densities in the main-scanning direction first. The calculation processing unit 11 divides the density distribution into a plurality of regions in the main-scanning direction, and distinguishes between a streak region and a non-streak region as follows. If an absolute value of a difference between an average density of a target one of the regions and the average density of the (overall) density distribution is equal to or larger than a predetermined threshold (e.g., 0.10), which is a determination criterion, the calculation processing unit 11 determines the region as a streak region, but if the absolute value is smaller than the threshold, the calculation processing unit 11 determines the region as a non-streak region.

The method for distinguishing between a streak region and a non-streak region is not limited to the above-described method. The calculation processing unit 11 may distinguish between a streak region and a non-streak region by another method that does not calculate the average of the (overall) density distribution but uses an average density of adjacent ones of the divided regions and a threshold (e.g., 0.10) serving as a predetermined determination criterion. For example, the calculation processing unit 11 can distinguish a streak region and a non-streak region in such a manner that, if a density difference between a region A and a region B adjacent to each other is 0.12 and wherein a density difference between the region B and a region C adjacent to each other is 0.11, the calculation processing unit 11 determines the region B as a streak region and the regions A and C as non-streak regions.

The calculation processing unit 11 can detect an approximate region where a streak region appears by the above-described method. However, it is required to detect a streak region, where correction is actually to be applied (hereinafter, "correction region"), which is further smaller than the approximate region. For example, the correction region can be detected by the following method. The calculation processing unit 11 further divides the approximate region, which is distinguished as either a streak region or a non-streak region by the calculation processing unit 11, into 0.5-millimeter-width regions and calculates the reflectance differences of the regions. The calculation processing unit 11 calculates the differences on a region-by-region basis from an edge region at one end and defines a portion where the difference between adjacent regions exceeds the above-described threshold as a division point A. The calculation processing unit 11 further calculates the differences on the region-by-region basis from the division point A and defines a portion where the difference between adjacent regions exceeds the threshold again as a division point B. The calculation processing unit 11 determines that the region between the division points A and B is a correction region.

This method allows, even if a plurality of thin streak regions appear in a detection area, detecting the plurality of thin streak regions.

Step S5: Generate Tone-Value Correction Information

The image-information correcting unit 13 generates tone-value correction information using the density of the streak region calculated by the calculation processing unit 11 at Step S4. For example, a table generated from a density-versus-tone-value relationship measured and stored in advance may be used as the tone-value correction information. For another example, the image-information correcting unit 13 may generate the tone-value correction information in a form other than the table and generate it so as to correct a tone value in a way that depends on a difference relative to the average density value in the main-scanning direction. For example, the tone-value correction information may be configured to correct a tone value by incrementing or decrementing it by 1 for each density difference of 0.003.

Figure 7:
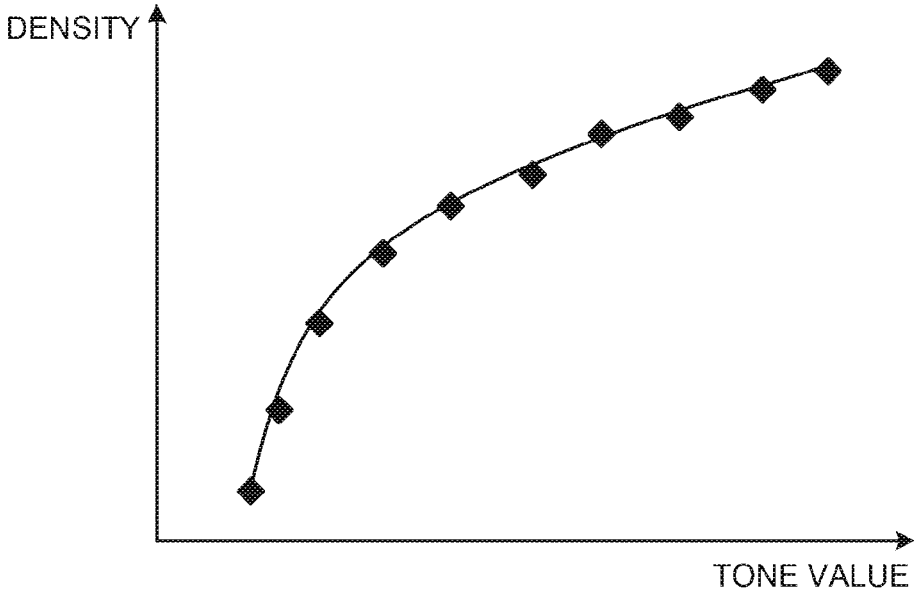
FIG. 7 is a diagram illustrating density-versus-image-tone-value relationship.

FIG. 7 illustrates a density-versus-image-tone-value relationship. As in the case of the reflectance-versus-density relationship described above, it is preferable to measure and store this relationship as a table in advance or generate a table representing this relationship by carrying out measurement during calibration. With this method, the image-information correcting unit 13 can calculate a tone value corresponding to a density and obtain a tone-value correction amount as the tone-value correction information for correcting a density value of the streak region to a density value of the non-streak region.

Step S6: Correct Image Information Using Tone-Value Correction Information

The correction control unit 14 corrects image information using the tone-value correction information generated at Step S5. At Step S6, the correction control unit 14 corrects the tone value of the streak region by using the tone-value correction amount calculated as described below as the tone-value correction information. Specifically, the correction control unit 14 corrects the tone value of the streak region by subtracting the tone-value correction amount from the tone value.

Figure 8:
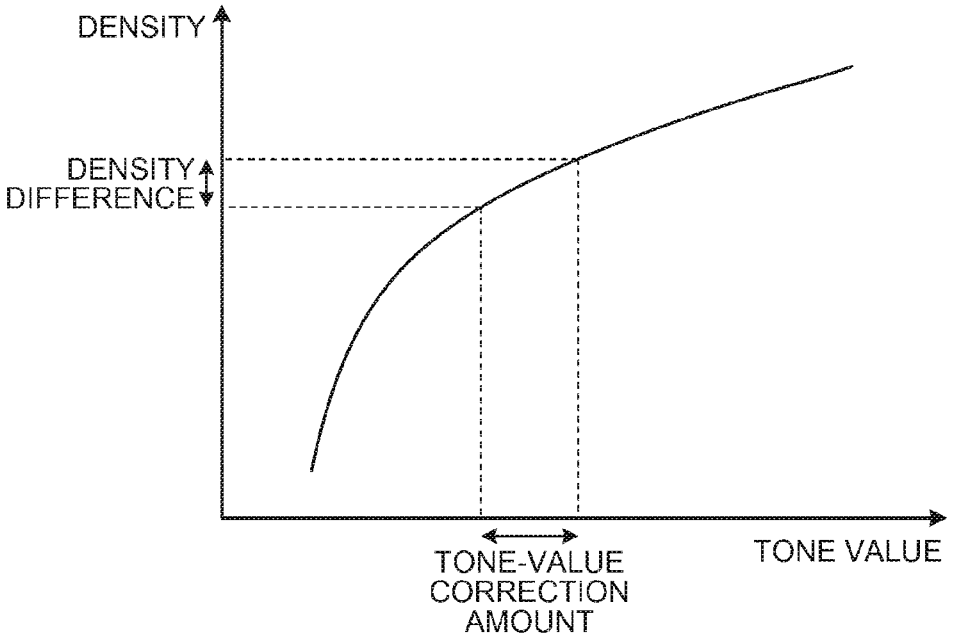
FIG. 8 is a diagram describing tone-value correction information and image information correction using the tone-value correction information.

The tone-value correction information and correction of image information using the tone-value correction information are described below with reference to FIG. 8. The image-information correcting unit 13 calculates the tone-value correction amount as illustrated in FIG. 8 by using the density-and-tone-value relationship illustrated in FIG. 7 as a method for calculating the tone-value correction amount from the density difference between the streak region and the non-streak region. Specifically, the image-information correcting unit 13 can calculate Gl and Gr from Dl and Dr using the above-described relationship, where Dl is the density of the streak region, Dr is the density of the non-streak region, Gl is a calculated tone value of the streak region, and Gr is a calculated tone value of the non-streak region. The image-information correcting unit 13 then calculates Gc, which is the tone-value correction amount, from Gc=Gl−Gr. The correction control unit 14 calculates G, which is a post-correction tone value, from G=Go−Gc, which can be expressed as G=Go−(Gl−Gr), where Go is a pre-correction tone value.

Step S7: Output Image Information

The correction control unit 14 outputs the post-correction image information corrected at Step S6.

Figure 9:
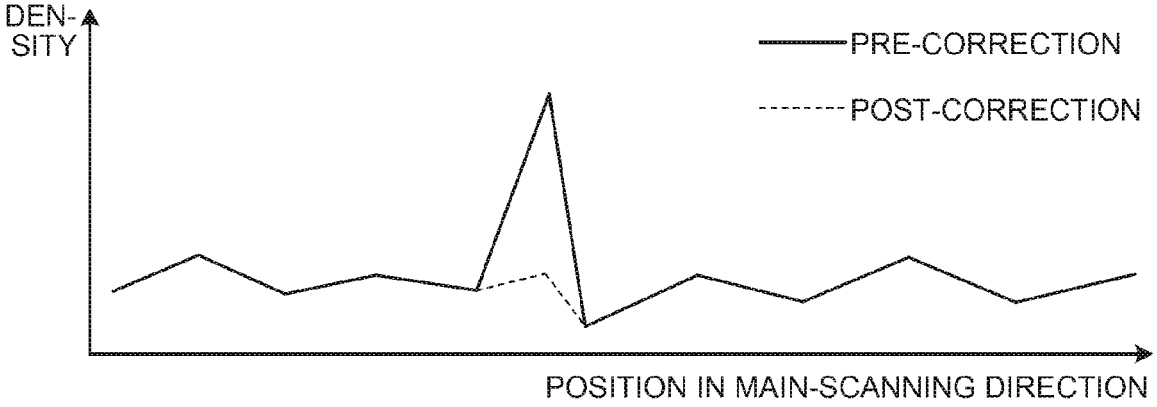
FIG. 9 is a diagram illustrating an example of a pre-correction density profile and a post-correction density profile in the main-scanning direction.

FIG. 9 illustrates an example of a pre-correction density profile and a post-correction density profile in the main-scanning direction. As illustrated in FIG. 9, the image forming apparatus 1 of the present embodiment can eliminate a streak by applying the tone value correction to a position where density is high and the streak appears, thereby reducing the density difference relative to the other regions.

Figure 10:
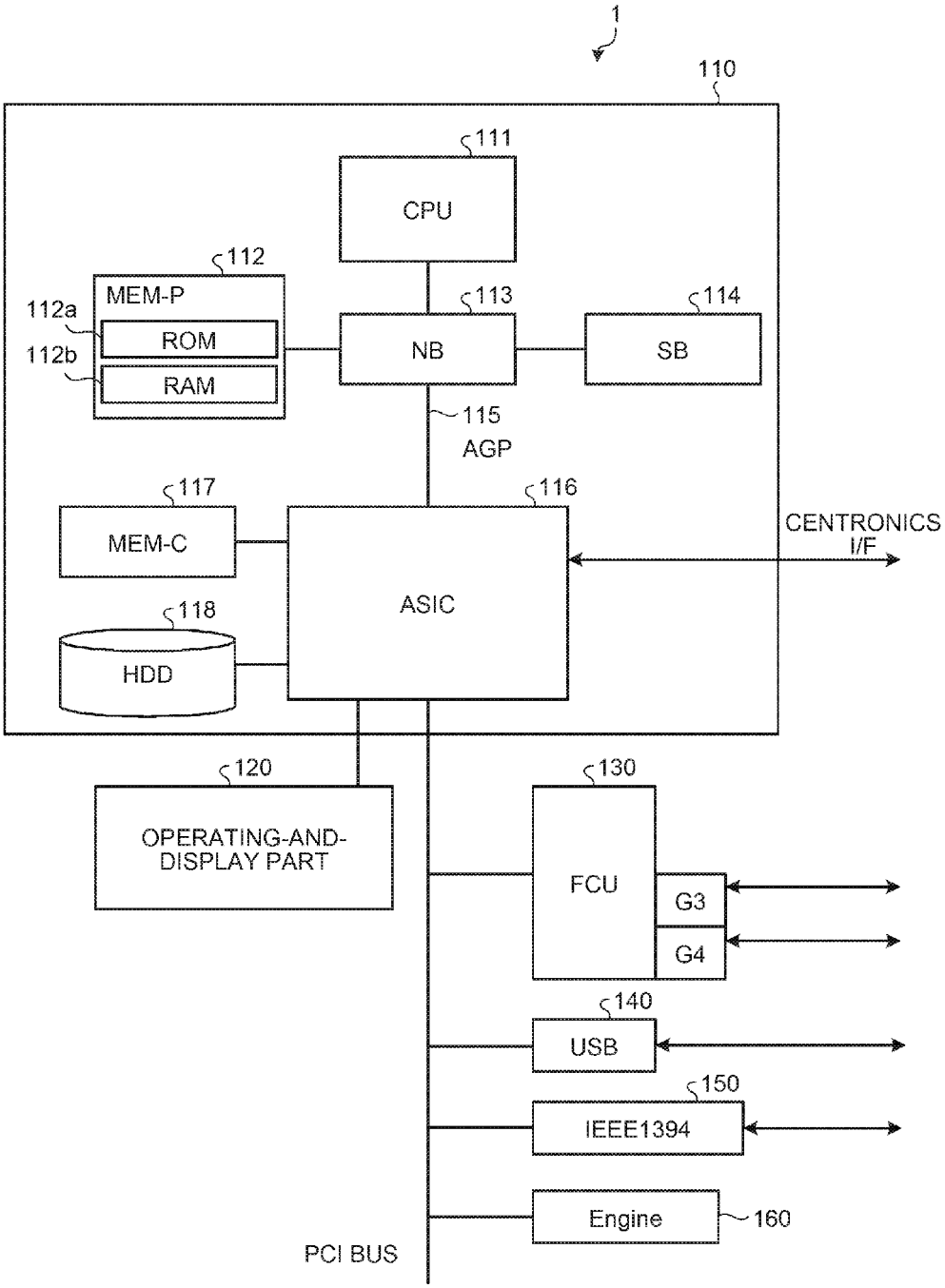
FIG. 10 is a block diagram illustrating a hardware configuration of a typical MFP.

An overall hardware configuration of the image forming apparatus 1 is described below by way of example of an MFP. FIG. 10 is a block diagram illustrating a hardware configuration of a typical MFP. The portion described above with reference to FIG. 1 is included in an engine part (Engine) 160.

As illustrated in FIG. 10, the MFP (the image forming apparatus 1) is formed by connecting a controller 110 and the engine part 160 via a peripheral component interface (PCI) bus. The controller 110 controls the entire MFP, image rendering, communication, and inputs entered from an operating-and-display part 120. The engine part 160 is a printer engine (in this example, an electrophotographic printer engine) connectable to the PCI bus. The engine part 160 includes, in addition to what may be referred to as an engine portion, a portion for image processing, such as error diffusion, gamma correction, and the above-described density non-uniformity correction.

The controller 110 includes a CPU 111, a north bridge (NB) 113, a system memory (MEM-P) 112, a south bridge (SB) 114, a local memory (MEM-C) 117, an application-specific integrated circuit (ASIC) 116, and a hard disk drive (HDD) 118. The controller 110 is formed by connecting the north bridge (NB) 113 and the ASIC 116 via an accelerated graphics port (AGP) bus 115. The MEM-P 112 includes a read only memory (ROM) 112*a* and a random access memory (RAM) 112*b*.

The CPU 111 controls the entire MFP and includes a chip set including the NB 113, the MEM-P 112, and the SB 114. The CPU 111 is connected to other equipment via the chip set.

The NB 113 is a bridge for connecting the CPU 111 to the MEM-P 112, the SB 114, and the AGP bus 115. The NB 113 includes a PCI master, an AGP target, and a memory controller that controls reading and writing from and to the MEM-P 112 and the like.

The MEM-P 112 is a system memory for use as a memory for storing program instructions (hereinafter, "programs") and data, a memory for loading programs and data thereinto, a memory for printer's image rendering, and the like. The MEM-P 112 includes the ROM 112*a* and the RAM 112*b*. The ROM 112*a* is a read-only memory for use as the memory for storing programs and data. The RAM 112*b* is writable and readable memory for use as the memory for loading programs and data thereinto, the memory for printer's image rendering, and the like.

The SB 114 is a bridge for connecting the NB 113 to PCI devices and peripheral devices. The SB 114 is connected to the NB 113 via the PCI bus. A network interface (I/F) part and the like are also connected to the PCI bus.

The ASIC 116 is an integrated circuit (IC) for use in image processing and includes a hardware element for image processing. The ASIC 116 functions as a bridge that connects between each of the AGP bus 115, the PCI bus, the HDD 118, and the MEM-C 117. The ASIC 116 includes a PCI target and an AGP master, an arbiter (ARB) serving as the core for the ASIC 116, a memory controller that controls the MEM-C 117, a plurality of direct memory access controllers (DMACs) that performs image data rotation and the like by hardware logic, and a PCI unit that performs data transfer to and from the engine part 160 via the PCI bus. A facsimile control unit (FCU) 130, a universal serial bus (USB) 140, and an IEEE 1394 (the Institute of Electrical and Electronics Engineers 1394) interface 150 are connected to the ASIC 116 via the PCI bus. An operating-and-display part 120 is directly connected to the ASIC 116.

The MEM-C 117 is a local memory for use as a copy-image buffer and a code buffer. The hard disk drive (HDD) 118 is storage for accumulating image data, programs, font data, and forms.

The AGP bus 115 is a bus interface for a graphics accelerator card introduced to accelerate graphics operations. The AGP bus 115 allows direct access to the MEM-P 112 at a high throughput, thereby enabling faster processing using the graphics accelerator card.

Although the overall hardware configuration of the image forming apparatus 1 has been described above by way of example of the MFP, the configuration of the above-described embodiment is applicable to any electrophotographic image forming apparatus, examples of which include single-function copiers and printers.

An image processing program to be executed by the image forming apparatus 1 of the above-described embodiment may be provided as being stored in a ROM, a flash memory, or the like in advance. The image processing program may be configured to be provided as being recorded in a non-transitory computer-readable recording medium, such as a CD-ROM, a flexible disk (FD), a CD-R, or a digital versatile disk (DVD), as an installable file or an executable file. The image processing program may be configured to be stored in a computer connected to a network, e.g., the Internet, and provided or distributed by being downloaded via the network, e.g., the Internet.

According to an aspect of the present invention, an electrophotographic image forming apparatus can advantageously reduce an image defect resulting from density nonuniformity of single-color and, furthermore, reduce an image defect resulting from density nonuniformity of mixed-color caused by the reduction of the density nonuniformity of single-color.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electrophotographic image forming apparatus for forming an image in accordance with image information, the image forming apparatus comprising:

an image forming device configured to form an image on an intermediate transfer belt, the image being uniform in area percentage of each of primary colors and a secondary color; and circuitry configured to measure amounts corresponding to density distribution of residual toner left on the intermediate transfer belt, on which the image uniform in area percentage of each of the primary colors and the secondary color is formed and from which toner is transferred onto a recording medium, in a main-scanning direction, the measured amounts corresponding to the density distribution of residual toner left on the intermediate transfer belt in an area where the secondary color was formed correspond to the density distribution of a single primary color; and correct a tone value of the image information so as to reduce density nonuniformity of a streak region observed in the measured amounts corresponding to the density distribution in the main-scanning direction.

2. The image forming apparatus according to claim 1, further comprising storage configured to store information representing relationship between density and the amount corresponding to the density distribution, wherein the circuitry obtains the density distribution in the main-scanning direction from the information, the information representing the relationship between density and the amount corresponding to the density distribution in the storage, and the amounts corresponding to the density distribution in the main-scanning direction measured by the circuitry, and corrects the tone value of the image information so as to reduce the density nonuniformity of the streak region observed in the density distribution in the main-scanning direction on the basis of the density distribution in the main-scanning direction.

3. The image forming apparatus according to claim 2, wherein the circuitry includes a reflectance measuring instrument, and the amounts corresponding to the density distribution are reflectances.

4. The image forming apparatus according to claim 2, wherein the circuitry distinguishes between the streak region and a non-streak region on the basis of a difference between an average density of the density distribution in the main-scanning direction and an average density of each of regions, into which the density distribution in the main-scanning direction is divided.

5. The image forming apparatus according to claim 2, wherein the circuitry distinguishes whether each of regions, into which the density distribution is divided in the main-scanning direction, is either the streak region or a non-streak region on the basis of a density difference between adjacent ones of the regions.

6. The image forming apparatus according to claim 2, wherein the circuitry distinguishes between the streak region and a non-streak region by applying, to each of divided regions, a determination criterion as to whether an absolute value of a difference between an average density in the main-scanning direction and an average density of the divided region is equal to or higher than a predetermined threshold.

7. The image forming apparatus according to claim 2, wherein the circuitry detects the streak region and a non-streak region by applying, to each of regions divided in the main-scanning direction, a determination criterion as to whether an absolute value of a density difference between adjacent ones of the regions is equal to or higher than a predetermined threshold.

8. The image forming apparatus according to claim 1, wherein the circuitry corrects a tone value of image information representing the streak region using the following equation:

$$G=Go-(Gl-Gr),$$

where G is a post-correction tone value, Go is the original tone value, Gl is a calculated tone value of the streak region, and Gr is a calculated tone value of a non-streak region.

9. An image processing method for an electrophotographic image forming apparatus for forming an image in accordance with image information, the image processing method comprising:

forming, by an image forming device, an image on an intermediate transfer belt, the image being uniform in area percentage of each of primary colors and a secondary color;

measuring amounts corresponding to density distribution of residual toner left on the intermediate transfer belt, on which the image uniform in area percentage of each of the primary colors and the secondary color is formed and from which toner is transferred onto a recording medium, in a main-scanning direction, the measured amounts corresponding to the density distribution of residual toner left on the intermediate transfer belt in an area where the secondary color was formed correspond to the density distribution of a single primary color; and correcting a tone value of the image information so as to reduce density nonuniformity of a streak region observed in the measured amounts corresponding to the density distribution in the main-scanning direction.

10. A non-transitory computer-readable recording medium storing program instructions that, when executed in an electrophotographic image forming apparatus for forming an image in accordance with image information, cause the image forming apparatus to perform an image processing method comprising:

forming an image on an intermediate transfer belt, the image being uniform in area percentage of each of primary colors and a secondary color;

measuring amounts corresponding to density distribution of residual toner left on the intermediate transfer belt, on which the image uniform in area percentage of each of the primary colors and the secondary color is formed and from which toner is transferred onto a recording medium, in a main-scanning direction, the measured amounts corresponding to the density distribution of residual toner left on the intermediate transfer belt in an area where the secondary color was formed correspond to the density distribution of a single primary color; and correcting a tone value of the image information so as to reduce density nonuniformity of a streak region observed in the measured amounts corresponding to the density distribution in the main-scanning direction.

* * * * *